United States Patent [19]

Rick

[11] Patent Number: 4,918,850

[45] Date of Patent: Apr. 24, 1990

[54] GAS SEAL REVOLVER

[76] Inventor: Jens O. Rick, 220 Sanborn, Big Rapids, Mich. 49307

[21] Appl. No.: 319,928

[22] Filed: Mar. 6, 1989

Related U.S. Application Data

[63] Continuation of Ser. No. 135,055, Dec. 18, 1987, abandoned.

[51] Int. Cl.[5] ..... F41C 1/02

[52] U.S. Cl. ..... 42/59; 42/63; 42/65; 42/66

[58] Field of Search ..... 42/59, 65, 63, 66, 39.5; 89/157

[56] References Cited

U.S. PATENT DOCUMENTS

| | | | |
|---|---|---|---|
| 182,646 | 9/1876 | Davis | 42/59 |
| 213,221 | 3/1879 | Mauser | 42/59 |
| 222,167 | 12/1879 | Wesson | 42/59 |
| 245,792 | 8/1881 | Cory | 42/59 |
| 269,890 | 1/1883 | Smith | 42/59 |
| 338,760 | 3/1886 | Merritt | 42/65 |
| 373,893 | 11/1887 | Howe | 42/59 |
| 473,903 | 5/1892 | Bovy | 42/59 |
| 584,631 | 6/1897 | Fosbery | 42/59 |
| 726,109 | 4/1903 | Stow | 42/59 |
| 990,669 | 4/1911 | Rodehaver | 42/66 |
| 1,047,054 | 12/1912 | Holmes | 89/1.3 |
| 1,077,135 | 10/1913 | Guerrero | 42/59 |
| 1,965,637 | 7/1934 | Frederich et al. | 42/59 |
| 2,835,171 | 5/1958 | Lyon | 89/1.3 |
| 2,866,386 | 12/1958 | Lucht | 89/1.3 |
| 3,055,270 | 9/1962 | Miller | 89/157 |
| 3,159,938 | 12/1964 | Treat et al. | 42/59 |
| 3,561,319 | 2/1971 | Joyce et al. | 42/59 |
| 4,228,607 | 10/1980 | Casull | 42/66 |
| 4,426,802 | 1/1984 | Walker | 42/59 |
| 4,539,771 | 9/1985 | Sirkis | 42/64 |
| 4,581,835 | 4/1986 | Brouthers et al. | 42/65 |
| 4,694,602 | 9/1987 | Pust | 42/59 |

FOREIGN PATENT DOCUMENTS

| | | | |
|---|---|---|---|
| 7787 | of 1892 | United Kingdom | 42/59 |

OTHER PUBLICATIONS

Taylerson, A. W. F., *Revolving Arms,* Walker and Co., 1967, p. 89.

Smith, W. H. B., *The Book of Pistols and Revolvers* (updated by Joseph E. Smith), Stackpole Co., 1968, pp. 151–153 (re the Nagant Revolver).

Boothroyd, Geoffrey, *The Handgun,* Crown Publishing Co., 1970, pp. 267–270 (re the Nagant Revolver).

Thalheimer, Ronald, Percussion Revolvers, Van Hoffman Press, 1970, pp. 92, 102 (re the Iverson Turret Revolver and the Gehnart Monitor Turret Revolver).

*Primary Examiner*—Deborah L. Kyle
*Assistant Examiner*—Michael J. Carone
*Attorney, Agent, or Firm*—Price, Heneveld, Cooper, DeWitt & Litton

[57] ABSTRACT

A gas seal revolver which includes a barrel having a longitudinal bore therethrough, a rotatably mounted cylinder positioned adjacent to the barrel and having a plurality of chambers therein, and a sealing and aligning structure oriented between the barrel and the cylinder to thereby form a leak resistant gas seal when the barrel is moved against the end face of the cylinder. The barrel and cylinder assembly are movable mounted to the frame such that the revolver may be tipped open for easy loading and cleaning of the operative parts contained therein. The revolver also includes an indexing mechanism which cooperates with notches along the outer periphery of the cylinder in order to incrementally move the cylinder so that the chambers are moved into and out of preliminary alignment with the barrel bore. The barrel is also prevented from being opened during any phase of trigger motion thereby ensuring that the operator will not open the barrel during the firing cycle. In the rest (or idle) position, the chambers are not in alignment with the firing pin or the barrel so that any blow to the hammer, which might occur, such as if the revolver is dropped, will not strike a primer of a cartridge.

26 Claims, 4 Drawing Sheets

GAS SEAL REVOLVER

This is a continuation of co-pending application Ser. No. 135,055 filed on Dec. 18, 1987 now abandoned.

BACKGROUND OF THE INVENTION

The present invention pertains to revolvers and in particular to revolvers of the gas seal type. Typically, in today's revolvers, the cylinder is made with a plurality of cartridge chambers and is rotatably mounted so that the chambers may be successively aligned with the barrel bore for firing. This two-part construction of the firing passage presents two major problems These are: the opportunity for propellant gas leakage at the junction between the barrel bore and the cylinder chamber, and the requirement for precise alignment between the barrel bore and the cylinder chamber at the moment of firing. If the cylinder chamber is not aligned precisely behind the barrel bore, so that the projectile may move unhindered from the chamber to the bore, the projectile can be shaved or deformed in its attempt to escape out the bore during firing. Also, dangerously high chamber pressure can result if the projectile's journey from chamber to bore is interfered with or inhibited due to non-alignment between chamber and bore. If propellant gas is allowed to escape between the cylinder chamber and barrel bore, the projectile suffers a loss in velocity and becomes less effective.

One solution which has been developed to alleviate gas leakage is the provision of a gas seal located between the barrel and the cylinder. The seal usually is formed by providing an annular ridge about the barrel bore and opposing countersinks about each chamber. Prior to the time of firing, the cylinder is typically pressed forwardly against the barrel so that the ridge is matingly received within the directly opposing countersink. Although, one design, the Iverson turret revolver, did operate the gas seal by moving the barrel back into contact with a cylinder consisting of chambers radiating out from a central point and all lying in a single plane. In any event, the mating engagement, then, effectively prevents any substantial loss of gases between the barrel and cylinder and also forces the cylinder into alignment with the bore. However, past gas seal revolvers have entailed complicated and/or cumbersome mechanisms for pressing the cylinder forwardly upon firing.

Gas seal revolvers, as with all revolvers, require the frequent loading of cartridges into the chambers and frequent cleaning of the revolver's operative parts to ensure its proper functioning. One effective design, aimed at easing the loading and cleaning operations, has been the tip-open construction, such as disclosed in U.S. Pat. No. 4,539,771 issued to Sirkis, Sept. 10, 1985. In a tip-open revolver, the barrel and cylinder assembly are pivotally mounted to the frame, so that the revolver may be split open to expose the rearward face of the cylinder and many operative parts for easy loading and cleaning procedures. Yet, tip-open revolvers have invariably entailed additional latch structures for fastening the pivotal parts together, and thereby increase the revolver's complication and susceptibility to disrepair. Moreover, no gas seal revolvers have been developed which utilize the advantageous tip-open construction.

An additional difficulty encountered in the manufacture of revolvers involves the indexing mechanism. The indexing mechanism rotates the cylinder in predetermined increments to thereby successively align the chambers of the cylinder with the barrel bore. Traditionally, a driving pawl is provided to cooperate with a circular ratchet which is fixedly mounted to the rearward face of the cylinder about its central axis. The ratchet is relatively small and is spaced radially inwardly from the chambers. This arrangement, therefore, requires very precise machining, since a small deviation in the ratchet's position translates into a magnified deviation for the chamber. Any deviation of the chamber's position from true alignment with the barrel bore must be avoided, otherwise the projectile will be shaved, deformed, etc., which significantly disturbs the projectile's velocity and accuracy of its flight and can increase chamber pressure dangerously.

In an effort to alleviate this problem, several suggested solutions have focused on engaging the cylinder along its outer periphery (beyond the chambers), such as seen in U.S. Pat. Nos. 4,581,835 to Brouthers et al., 1,077,135 to Guerrero and 213,221 to Mauser. All these arrangements, however, present complicated and structurally weak arrangements for accomplishing the desired purpose. Hence, such structures are expensive to manufacture and have shortened life potential due to their susceptibility to disrepair.

SUMMARY OF THE INVENTION

In accordance with the present invention, a unique gas seal revolver is provided that overcomes all of the aforementioned problems. The gas seal revolver includes a barrel having a longitudinal bore therethrough, a rotatably mounted cylinder positioned adjacent to the barrel and having at least one chamber adapted to receive a cartridge therein, and a sealing structure oriented between the barrel and the cylinder. The sealing structure acts to form a leak resistant gas seal when the barrel and the end face of the cylinder abut and to ensure that accurate alignment between the barrel bore and the chambers is accomplished. The barrel and cylinder assembly is movably mounted to the frame such that the revolver may be opened for easy loading and cleaning of the operative parts contained therein. The present invention further includes an indexing mechanism which cooperates with notches near the outer periphery of the cylinder in order to incrementally move the cylinder so that the chambers are moved into and out of alignment with the barrel bore. This arrangement requires less precision in its manufacture since it operates at a greater radius than that of the chambers and performs only preliminary indexing prior to the accurate indexing during gas sealing. These and other objects, advantages and features of the present invention will be more fully understood and appreciated by reference to the written specification and appended drawings.

DETAILED DESCRIPTION OF THE PREFERRED EMBODIMENT

Figure 1:
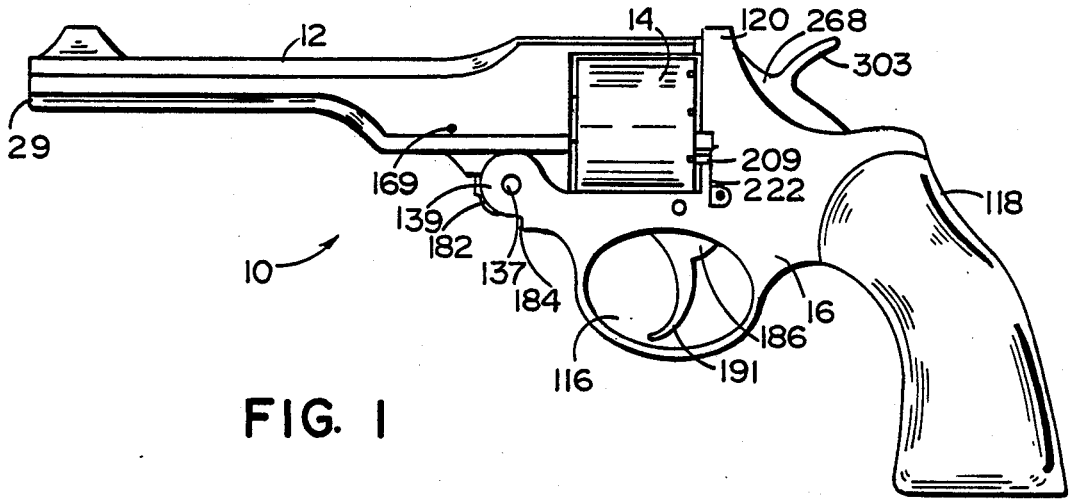
FIG. 1 shows a left side elevational view of a gas seal revolver embodying the present invention.

For purposes of description herein the terms "upper," "lower," "right," "left," "rear," "front," "vertical," "horizontal," and derivatives thereof shall relate to the invention as oriented in FIGS. 1 and 4–6. However, it is to be understood that the invention may assume various alternative orientations, except where expressly specified to the contrary. It is also to be understood that the specific devices and process illustrated in the attached drawings, and described in the following specification are simply exemplary embodiments of the inventive concepts defined in the appended claims. Hence, specific dimensions and other physical characteristics relating to the embodiments disclosed herein, are not to be considered as limiting, unless the claims expressly state otherwise.

In the preferred embodiment, revolver 10 is comprised of a barrel structure 12, a multi-chambered cylinder 14 and a frame 16 all of which are interconnected to form an efficient, safe and reliable revolver.

Barrel structure 12 (FIGS. 2 and 3) is of a generally elongate configuration having a forward shaft portion 18, a central body portion 20 and a pair of rearwardly projecting barrel extensions 22, 23. Extending longitudinally through shaft and body portions 18, 20 is a barrel bore 25 having a first end 27 which opens in a forward face 29 of barrel structure 12 and a second end 31 which opens in a rearward face 33 thereof. Barrel bore 25 is typically rifled for receiving therethrough the projectile as revolver 10 is fired.

Rearward face 33 is recessed within upper and lower barrel extensions 22, 23 and forms therewith a C-shaped configuration which defines an opening 35 adapted to receive cylinder 14 as will be more fully discussed below. On rearward face 33, about the marginal edges of second end 31 of barrel bore 25, is provided a first seal element 32 designed to cooperatingly form a leak resistant gas seal. Preferably, first seal element 32 is in the form of an annular ridge 34.

Opening in rearward face 33 directly below and extending parallel to barrel bore 25 is a stepped bore 37 Stepped bore 37 is closed by end wall 39 and therefore extends only partially through body portion 20 of barrel structure 12. Stepped bore 37 includes an outer bore portion 41 which is adjacent to rearward face 33, and an inner bore portion 43 of a smaller diameter which projects forwardly from outer bore portion 41. Due to the smaller diameter of inner bore portion 43, a rearwardly facing annular shoulder 45 is formed at the intersection of the two bore portions 41, 43.

Cylinder 14 (FIGS. 3, 10 and 16) includes an arcuate outer peripheral surface 47, opposing front and rear planar faces 49, 50, and a plurality of cylindrically shaped chambers 52 adapted to receive therein firing cartridges. Chambers 52 extend completely through cylinder 14 and have open ends 53, 55 at front and rear faces 49, 50. Chambers 52 are all identically shaped and radially spaced an equal distance from central axis 54 of cylinder 14.

On front face 49, about the marginal edges of open end 53 of each chamber 52, is provided a second seal element 57. Second seal element 57 is designed to matingly engage and align with first seal element 32 and therewith form a leak resistant gas seal between barrel bore 25 and chamber 52 and guide chamber 52 into alignment with barrel bore 25. Preferably, second seal element 57 is in the form of a countersink 59 shaped to matingly' receive ridge 34 therein.

Figure 16:
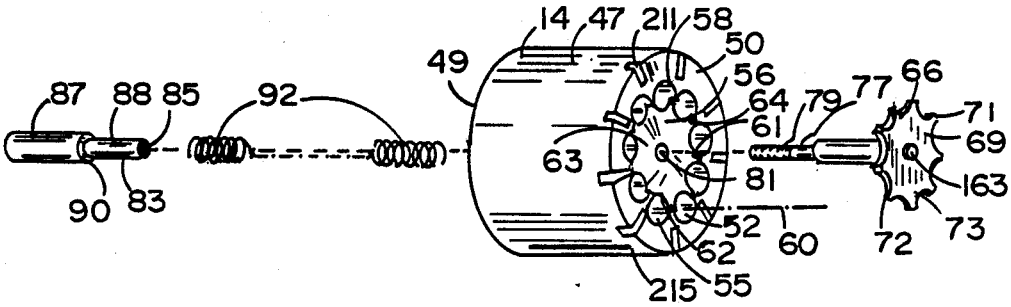
FIG. 16 is an exploded left rear perspective view of the cylinder and ejector assembly.

Referring to FIG. 16, rear face 50 of cylinder 14 includes a centrally positioned recess 56. Recess 56 has a circular plan shape in which the outer edge 58 thereof intersects the longitudinal axis of each chamber 52. Since recess 56 overlies chambers 52, the marginal edge 61 of base surface 63 is scalloped as defined by peaks 64 and rim portions 62 of chambers 52.

Figure 14:
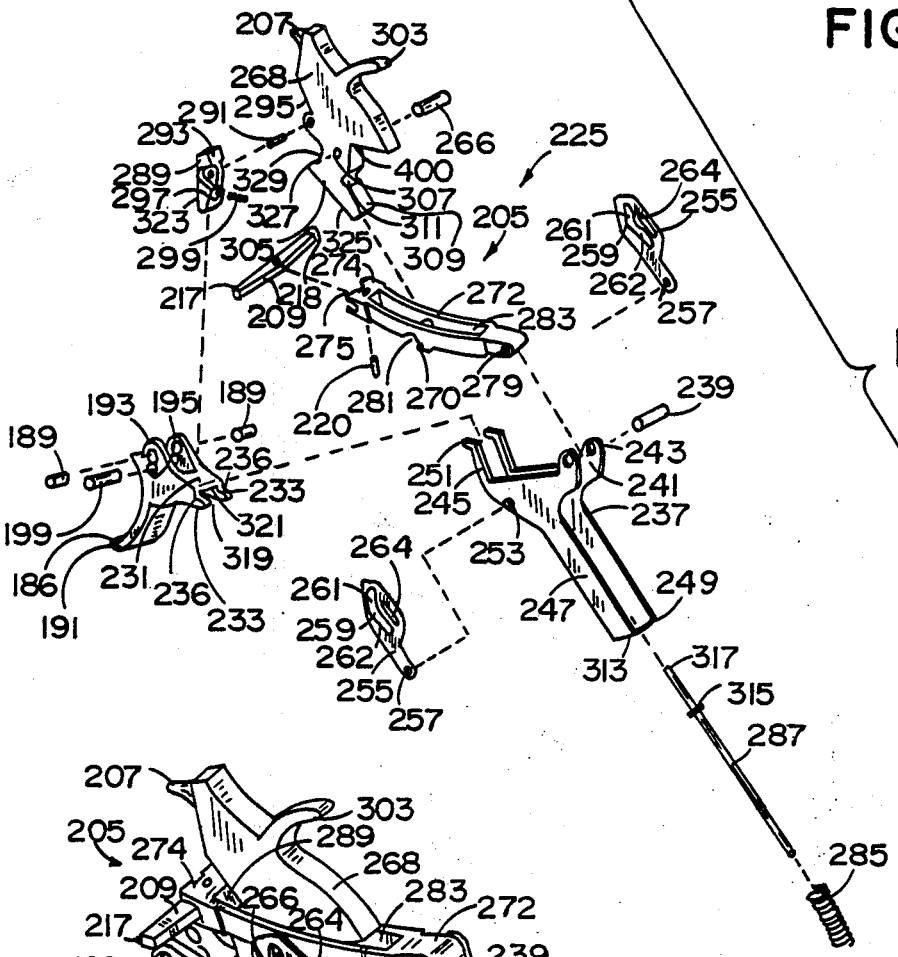
FIG. 14 is a left rear perspective view of an exploded view of the lock assembly of the gas seal revolver.
Figure 15:
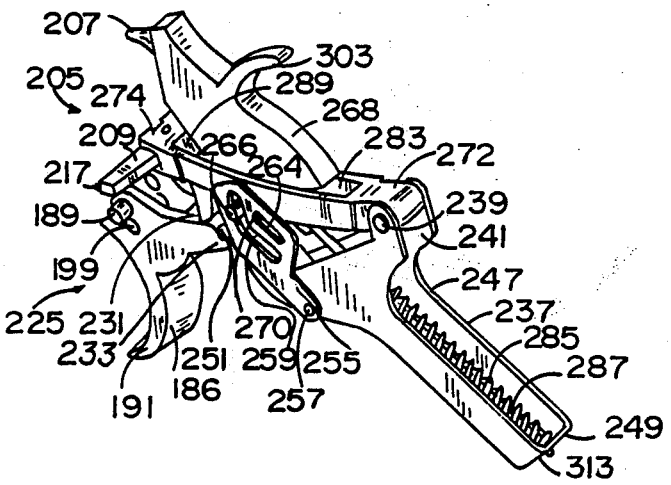
FIG. 15 is an assembled view of the lock assembly.

Received within recess 56 and directly overlying base surface 63 is an ejector 66 (FIG. 14). Ejector 66 includes an ejector plate 69 having a scalloped peripheral edge 72 which corresponds to marginal edge 61 of base 63. Ejector plate 69 is of the same depth as recess 56, and when received therein has an outer surface 73 which is flush with rear face 50 of cylinder 14. As clearly seen in FIG. 3, then, outer surface 73 in conjunction with rear face 50 defines an annular engagement portion 75 which is adapted to engage the rim of a firing cartridge received within chambers 52.

Ejector plate 69 (FIGS. 3, 4, 6 and 16) is fixedly attached to a central shaft 77 having a threaded distal end 79 which is received through an axial mounting bore 81 (FIG. 16) passing through cylinder 14. Mounting bore 81 is of a stepped configuration such that it matingly receives central shaft 77 of ejector 66 at its rearwardmost portion, but is enlarged throughout most of its passage through cylinder 14. This enlargement creates an inner shoulder 94 (FIGS. 4 and 6) which engages one end of ejector spring 92. Distal end 79 of shaft 77 is threadably received within threaded bore 85 (FIG. 16) of an ejector rod 83. Ejector rod 83 includes a two part outer surface 87, 88, wherein surface 88 is spaced radially inward from surface 87 to thereby define annular shoulder 90 adapted to engage the other end of ejector spring 92. Ejector spring 92 is typically a coil spring pre-loaded in compression which biases ejector plate 69 against base surface 63 of cylinder 14.

Also received within mounting bore 81 and around ejector rod 83 and ejector spring 92, is a tubular cylinder pin 97 (FIGS. 3, 4, 6 and 7). Cylinder pin 97 extends into mounting bore 81 and engages inner shoulder 94 of cylinder 14 with its rearward face 99. Cylinder pin 97 also extends into stepped bore 37 to rotatably mount cylinder 14 to barrel structure 12. As with ejector rod 83, cylinder pin 97 is also provided with a two part outer surface 101, 102 wherein surface 102 is spaced radially inward from surface 101 to thereby define a annular shoulder 104 which is adapted to engage one end of rebound spring 106 (FIG. 3), which is a coil spring pre-loaded in compression.

Figure 3:
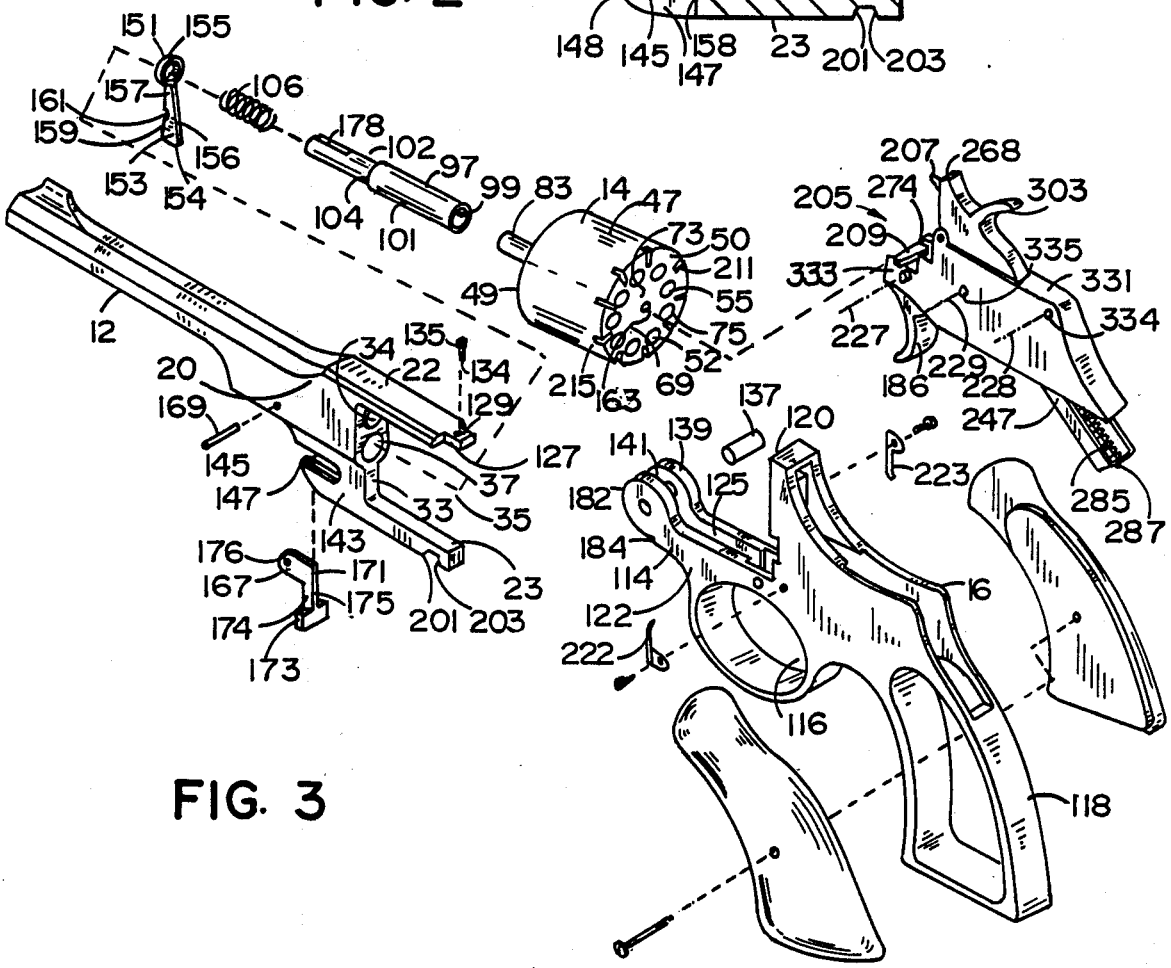
FIG. 3 shows an exploded view of the gas seal revolver.
Figure 4:
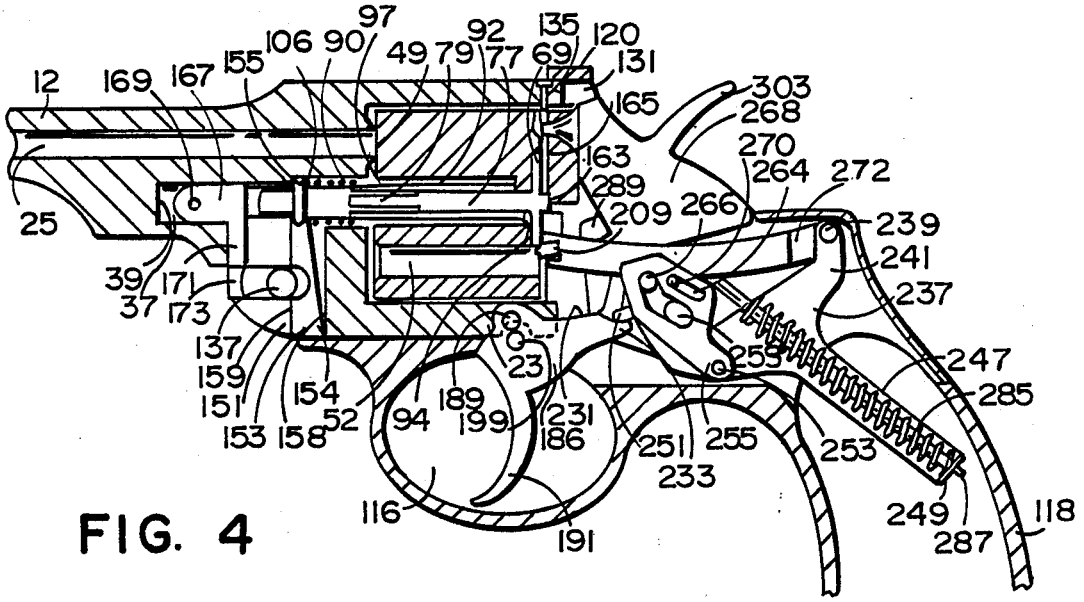
FIG. 4 shows a cross-sectional, left side view of the gas seal revolver in its rest position.

Rebound spring 106, acting against ring 155 of barrel lock 151 which acts against annular shoulder 45 in stepped bore 37 of barrel structure 12, biases cylinder 14 rearwardly away from rearward face 33 of barrel structure 12 through its engagement with cylinder pin 97 (FIGS. 3 and 4). The movement of cylinder 14 is sufficient such that annular ridge 34 will completely separate from countersink 59. Rebound spring 106, therefore, effectuates disengagement of the leak resistant gas seal after revolver 10 has been fired.

Figure 6:
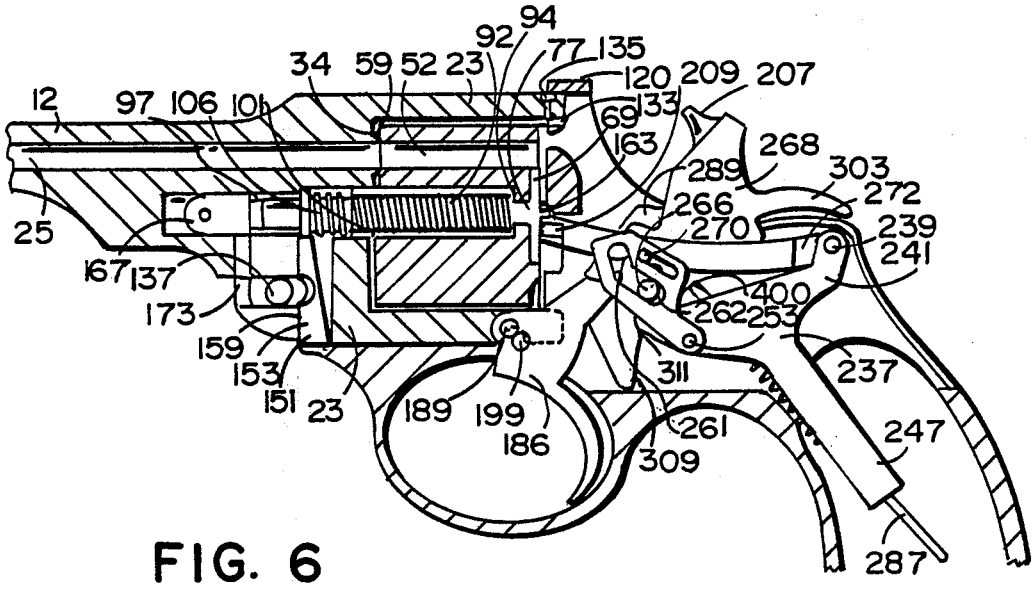
FIG. 6 is a cross-sectional, left side view of the gas seal revolver with the trigger firing stroke nearly completed.
Figure 7:
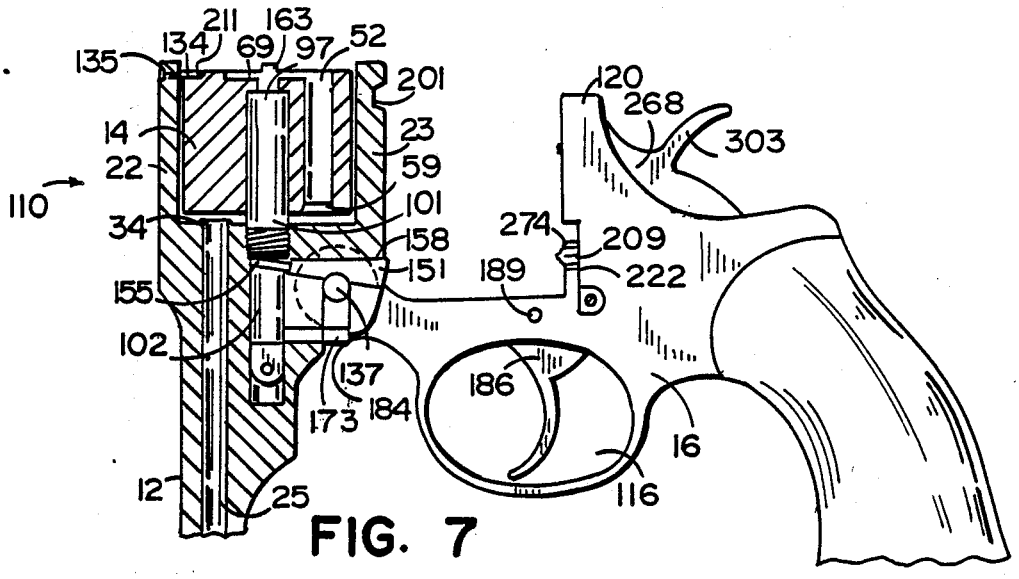
FIG. 7 is a partial cross-sectional left side view of the gas seal revolver in its tipped open position.
Figure 11:
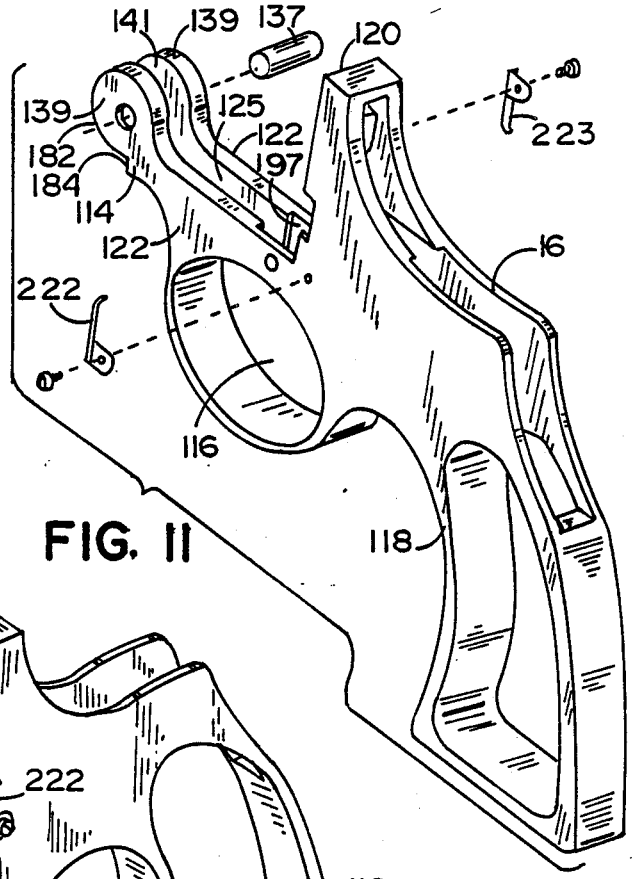
FIG. 11 is a left rear perspective view of a frame portion of the gas seal revolver.
Figure 12:
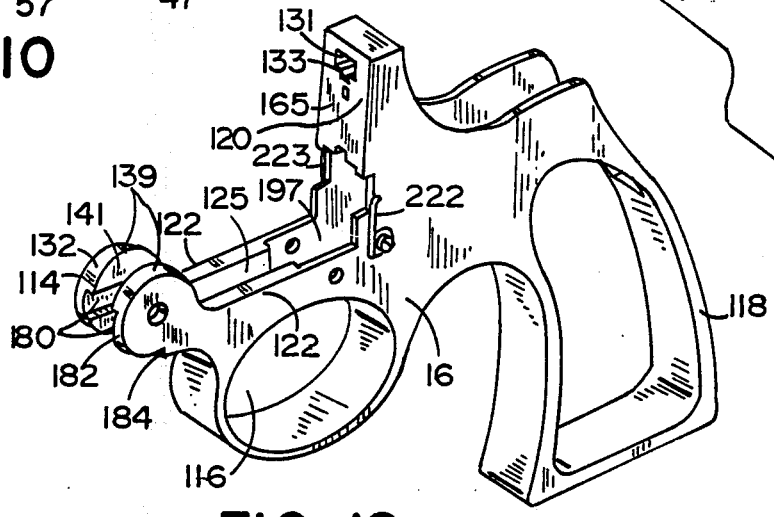
FIG. 12 is a left frontal perspective view of the frame portion of the gas seal revolver.

Barrel and cylinder assembly 110 in FIG. 7 is movably mounted to frame 16 (FIGS. 3, 11 and 12). Frame 16 includes a bifurcated forward portion 114, a trigger opening 116, a hand grip 118 and a standing breach 120. Bifurcated forward portion 114 includes a pair of parallel arms 122 which define therebetween an elongated channel 125. Lower barrel extension 23 is received within channel 125 to thereby interlock barrel 12 with frame 16. Distal end 127 of upper barrel extension 22 includes a stub 129 (FIG. 3) which projects rearwardly and is of a reduced transverse dimension. Standing breach 120 includes a passage 131 (FIG. 12 which is shaped to matingly receive therein stub 129 to thereby preclude any pivoting motion of barrel structure 12, while freely permitting the axial motion necessary for gas sealing firing. Passage 131 further includes a downwardly extending groove 133 which is adapted to receive therein the lower extending end 134 of a cylinder retaining screw 135 (FIGS. 3–6), which will be discussed in more detail below.

Barrel and cylinder assembly 110 is pivotally mounted to frame 16 through the use of a pivot pin 137 received through hubs 139 projecting forwardly from the ends of arms 122 (FIGS. 3–7 and 11). Hubs 139 interlockingly receive therebetween, in gap 141, base 143 of body portion 20 of barrel structure 12. Base 143 includes a longitudinally extending, forwardly opening slot 145 which receives therethrough pivot pin 137. This construction not only facilitates the pivoting of barrel and cylinder assembly 110 for opening and closing, but also permits barrel structure 12 to be moved longitudinally relative to frame 16 in order to accomplish the gas seal between cylinder chamber 52 and barrel bore 25.

Figure 2:
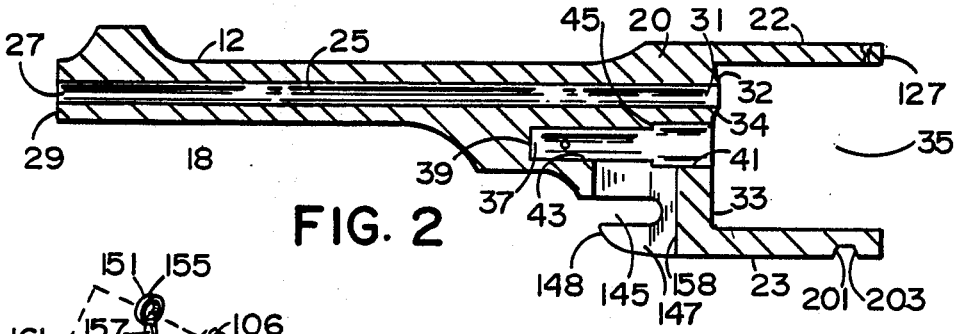
FIG. 2 shows a cross-sectional, left side view of a barrel portion of the gas seal revolver.

Extending vertically through the center of base 143, and projecting rearwardly a distance greater than slot 145, is a narrow cavity 147 (FIGS. 2 and 3). Cavity 147 extends vertically from the lower edge 148 of body portion 20 to stepped bore 37. Received within cavity 147 and stepped bore 37 is a substantially vertically oriented barrel lock 151 (FIGS. 3–7). Barrel lock 151 includes a lower plate member 153 having a substantially triangular configuration and received within cavity 147, and a ring 155 which is fixedly attached to the upper end 157 of plate member 153 and is designed to receive therethrough cylinder pin 97.

When revolver 10 is in its closed position (FIGS. 4, 5 and 6), plate member 153 is positioned such that its forward edge 159 engages pivot pin 137 and corner 154 on its rearward edge 156 engages abutment wall 158. Ring 155 is engaged by rebound spring 106 and forced to abut annular shoulder 45 of stepped bore 37, to thereby form the counteracting force for rebound spring 106, and hence regulate the depth of engagement of stub 129 with passage 131 as in FIG. 4 and as will be explained later. Forward edge 159 of plate member 153 further includes an arcuate depression 161 adapted to receive pivot pin 137 intermediately along the length thereof.

Figure 5:
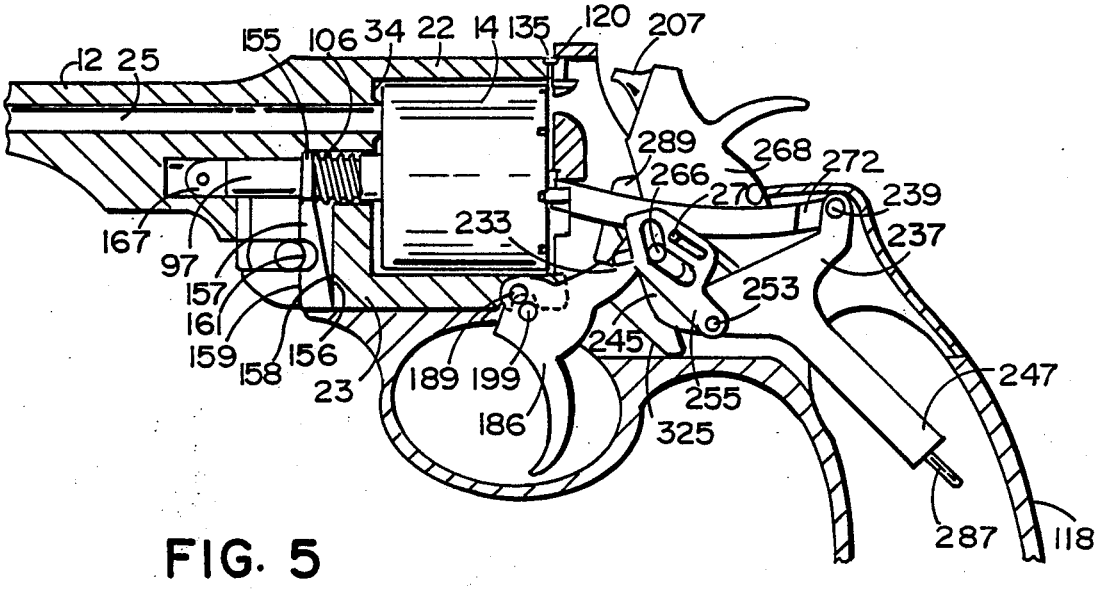
FIG. 5 shows a cross-sectional, left side view of the gas seal revolver with the trigger firing stroke half completed.

As is seen in FIGS. 4–6, rebound spring 106 is in a compressed state and exerts a force in both a forward and rearward direction. In the forward direction, spring 106 presses against ring 155 which abuts annular shoulder 45 of barrel structure 12. In the rearward direction, rebound spring 106 presses against annular shoulder 104 of cylinder pin 97. Cylinder pin 97 transfers the force to cylinder 14 by engaging inner shoulder 94 (FIGS. 4 and 6), which in turn, transfers the force to ejector 66 which in turn transfers the force to standing breach 120 or frame 16. Thus, the total effect of rebound spring 106 is to separate barrel structure 12 from frame 16. Ejector 66 includes a rearwardly projecting nub 163 (FIGS. 4–7 and 16) which engages forward face 165 (FIGS. 4, 5 and 12) of standing breach 120. The engagement of nub 163 on standing breach 120 also establishes the appropriate head space dimension for the firing of revolver 10 (the criticality of the head space dimension being well known and not subject to further discussion).

At the same time rebound spring 106 attempts to separate frame 16 from barrel structure 12, it also acts to lock these two parts together through the use of barrel lock 151. The locking force generated by rebound spring 106 overpowers the separating force of rebound spring 106 through the use of barrel lock 151 which divides these two forces up by a proportion of moments. The locking force is applied to frame 16 by the contact of barrel lock 151 with pivot pin 137. This locking force results from the moment created by rebound spring 106 operating over the distance between ring 155 and corner 154 of barrel lock 151. This moment tends to rotate barrel lock 151 counterclockwise about corner 154 which is in contact with abutment wall 158 until ring 155 rests against shoulder 45 of stepped bore 37. However, pivot pin 137 contacts barrel lock 151 to also resist this counterclockwise motion and maintain barrel structure 12 and frame 16 in static equilibrium. Since pivot pin 137 is at a lesser distance from corner 154 than rebound spring 106, the resisting force at pivot pin 137 must therefore be greater than the force of rebound spring 106 and will resist any forward travel of barrel structure 12. The equilibrium position thereby attained regulates the depth stub 129 engages passage 131 and at the same time enables rebound spring 106 to maintain a separating force necessary to disengage the gas seal between barrel structure 12 and cylinder 14 after firing.

In order to pivot barrel and cylinder assembly 110 about pivot pin 137 (FIG. 7 , barrel structure 12 must first be pulled axially in a forward direction relative to frame 16 to thereby release stub 129 from passage 131. This action is resisted by rebound spring 106 acting in concert with barrel lock 151 bearing against pivot pin 137. More specifically, as a user pulls barrel structure 12 axially forward, barrel lock 151 begins to move aWay from shoulder 45 due to its engagement with pivot pin 13 which is fixedly mounted to frame 16 (FIGS. 4 and 7). Also, since corner 154 engages abutment wall 158 (FIGS. 2 and 7) of barrel structure 12, plate member 153 begins to swing clockwise about this point toward abutment wall 158 and compress rebound spring 106 against annular shoulder 104 of cylinder pin 97. In these initial stages of barrel structure 12 movement, cylinder 14 remains pressed against standing breach 120 due to force of rebound spring 106, until its rearward face engages cylinder retaining screw 135 mounted through upper barrel extension 22. Further forward motion of barrel structure 12 from this point will also move cylinder 14 which then begins to compress rebound spring 106 against ring 155. This movement may continue until plate member 153 is trapped between pivot pin 137 and abutment wall 158 of barrel structure 12. At this extended position, stub 129 has been released from passage 131 and nub 163 on ejector 66 has separated from forward face 165 of standing breach 120 to permit barrel and cylinder assembly 110 to pivot counterclockwise about pivot pin 137.

Also released by this forward movement is a barrel retainer 167 which is mounted to barrel structure 12 through the use of a mounting pin 169 (FIGS. 3–7). Barrel retainer 167 is comprised of an L-shaped, upwardly extending leg 171 and a transversely extending foot 173 fixed to free end 174 of vertical leg 175. As illustrated in FIGS. 3–6, horizontal leg 176 is received within stepped bore 37 and is fixed therein by mounting pin 169 which passes transversely therethrough. To accommodate leg 176 in stepped bore 37, cylinder pin 97 is provided with a vertical kerf 178 (FIG. 3) which receives horizontal leg 176 therethrough. Extending downwardly from horizontal leg 176, into cavity 147, is vertical leg 175. Hubs 139 (FIG. 12) are provided along their inner surfaces with longitudinal grooves 180 which are aligned with pivot pin 137 and are adapted to receive therein foot 173. Hence, as barrel structure 12 is axially moved forward, foot 173 of barrel retainer 167 is slid forward in grooves 180 until barrel structure 12 reaches the end of its travel as discussed above, at which point foot 173 is clear of hubs 139.

With stub 129 and barrel retainer 167 both cleared of passage 131 and grooves 180, respectively, barrel and cylinder assembly 110 may be pivoted downwardly about pivot pin 137 approximately 90 degrees from its firing position (FIG. 7). Hubs 139 are provided with an outer arcuate peripheral track surface 182. As barrel and cylinder assembly 110 is pivoted downwardly, foot 173 of barrel retainer 167 rides along track 182 until it reaches end stop 184, which limits further pivoting of barrel and cylinder assembly 110. In this tipped-open position (FIG. 7), foot 173 is positioned against track 182 thereby causing barrel lock 151 to maintain constant contact with abutment wall 158 thereby preventing barrel lock 151 from inadvertently pivoting back into its locked position under the influence of rebound spring 106.

In its tipped open position (FIG. 7), revolver 10 may be easily loaded or unloaded by the user. Ejector plate 69 may be raised above rear face 50 of cylinder 14 for such purposes, against ejector spring 92, by a lever (not shown) or other known means. Also, many of the operative parts of revolver 10 are exposed for easy cleaning or further disassembly thereof. When the desired loading operations have been completed and revolver 10 is ready to fire once again, barrel and cylinder assembly 110 may be pivoted back into its horizontal firing position by employing an upward rotating action to barrel structure 12 thus performing the above discussed opening steps in the reverse order.

Revolver 10 is fired through the actuation of a trigger 186 (FIGS. 4–6, 14 and 15). Trigger 186 is pivotally mounted to frame 16 through the use of a pair of aligned trigger pins 189. Trigger 186 includes a downwardly extending finger receiving lip 191 positioned within trigger opening 116 for a conventional firing action. Upper portion 193 of trigger 186 is composed of two spaced apart parallel flanges 195 which receive therebetween lower barrel extension 23 and pivotally mount to frame 16 by receiving trigger pins 189. Channel 125 is widened at its rearward end 197 (FIG. 12) to accommodate the receipt of flanges 195 therein. Attached to flanges 195 and fixedly positioned therebetween, is a camming pin 199. Camming pin 199 is juxtaposed to trigger pins 189 and is positioned generally beneath lower barrel extension 23.

Adjacent trigger pins 189, in lower barrel extension 23, is a downwardly extending notch 201 (FIGS. 2–6). Notch 201 is oriented so as to receive therein and engage camming pin 199 as trigger 186 is pivoted about trigger pins 189. During the first fifty percent of the trigger firing stroke (FIG. 5), camming pin 199 is moved upwardly into engagement with rear wall 203 of notch 201, but provides no motion to barrel structure 12. From this position and thereafter in the firing stroke, camming pin 199 prevents barrel structure 12 from experiencing any forward motion. This construction, then, operates as a safety feature which precludes the revolver 10 from accidentally tipping open during the trigger firing stroke, or upon firing. With this construction, an additional safety feature exists in that a full firing stroke of trigger 186 is not possible if barrel structure 12 is prevented from completing its full rearward motion such as might occur if cylinder 14 is in a rotational position which does not offer second seal element 57 on cylinder face 49 to first seal element 32 on barrel structure 12. Any other inhibiting factor that prevents barrel structure 12 from rearward motion will also likewise prevent trigger 186 from completing the firing stroke.

As the user continues to pull trigger 186 rearwardly in its firing stroke, camming pin 199 applies a camming force to lower barrel extension 22, and thereby moves barrel structure 12 rearwardly. This movement positions ridge 34 into an aligned countersink 59 for forming the leak resistant gas seal and ensuring a final precise alignment of barrel bore 25 and cylinder chamber 52. Cylinder 14 is held stationary during the firing stroke by the abutment of nub 163 against standing breach 120. Of course, notch 201 is shaped to accommodate the arcuate path of camming pin 199 as it cams barrel structure 12 rearwardly. As seen in FIG. 6, ridge 34 is securely received within countersink 59 at ninety-nine percent of the trigger stroke, which is directly before firing.

Figure 10:
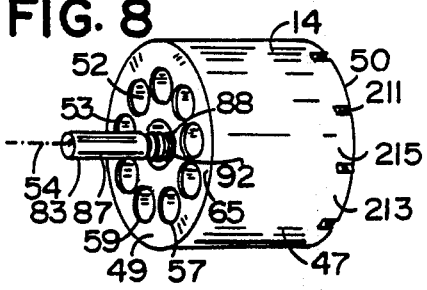
FIG. 10 is a left frontal perspective view of a cylinder and ejector portion of the gas seal revolver.

Another aspect of revolver 10 of the present invention, pertains to the indexing mechanism 205. Indexing mechanism 205 performs the rotation of cylinder 14 to successively align different chambers 52 with barrel bore 25. More specifically, indexing mechanism 205 includes a pivotally mounted hand 209 which is adapted to engage with grooves 211 provided in rear face 50 of cylinder 14. As seen in FIGS. 3, 10 and 16, a plurality of grooves 211 are provided along the marginal edge 213 of rear face 50 and opening through end portion 215 of outer peripheral surface 47. One groove 211 is positioned symmetrically between each pair of chambers 52. In the preferred embodiment, nine chambers 52 and nine corresponding grooves 211 are provided in cylinder 14, however, any practical number of chambers and grooves could be provided therein. By constructing grooves 211 radially beyond chambers 52 high precision machining may be avoided, because any deviation in the position of grooves 211 results in a diminished deviation for chamber 52. Additionally, in the preferred embodiment, any small deviation that may result will be eliminated through the mating engagement of ridge 34 and countersink 59.

In the rest position of revolver 10 (FIG. 4), that is, when trigger 186 is fully forward at zero percent of trigger stroke, cylinder 14 is oriented such that chambers 52 are offset from barrel bore 25 and firing pin 207. This arrangement obviates the risk that the revolver 10 could inadvertently fire if the revolver were dropped, bumped, etc. More specifically, during the first fifty percent of the trigger firing stroke, cylinder 14 is rotated a first half step (i.e. twenty degrees with a cylinder having nine chambers) to align on chamber 52 with barrel bore 25 and firing pin 207. After firing, in the last fifty percent of the trigger rest stroke, cylinder 14 is rotated a second half step, e.g. another twenty degrees, to again offset chambers 52 such that peaks 64 (FIG. 16) and margins 65 (FIG. 10) are aligned with barrel bore 25 and firing pin 207.

Furthermore, barrel structure 12 is prevented from moving rearwardly into sealing engagement with cylinder 14 when in a rest position. In this position, chambers 52 are offset with barrel bore 25 so that margins 65 (between chambers 52) abut annular ridge 34 if barrel structure 12 is inadvertently pushed rearwardly by dropping, bumping, etc. of the revolver 10. Consequently, this aspect of revolver 10 prevents annular ridge 34 from interfering with the rotation of cylinder 14 by indexing mechanism 205 during the initial phase of firing stroke.

In summary, revolver 10 is fired by a user pulling trigger 186 rearward. During the first fifty percent of trigger movement during the firing stroke, cylinder 14 is rotated by indexing mechanism 205 so that one chamber 52 is placed into preliminary alignment with barrel bore 25 and firing pin 207. During the next forty-nine percent of trigger movement in the firing stroke, barrel structure 12 is moved rearward so that ridge 34 is received within countersink 59 of corresponding chamber 52 to form the leak resistant gas seal and ensure that the precise alignment exists between barrel bore 25 and countersink 59. The remaining one percent of trigger stroke, is used to release the hammer and fire the revolver. After firing, trigger 186 is relaxed under the influence of spring 285 toward its rest position. During the first fifty percent of trigger movement toward its rest position, rebound spring 106 biases barrel structure 12 forward to remove ridge 34 from countersink 59. During its final fifty percent of trigger movement toward its rest position, indexing mechanism 205 rotates cylinder 14, so that chambers 52 are once again offset from barrel bore 25 and firing pin 207.

Indexing mechanism 205 includes for operation (FIGS. 14 and 15), a hand 209 having fingers 217, 218 provided on the ends thereof. Hand 209 is pivoted about a vertical hand pin 220 such that one of the fingers 217 or 218 is always received within one of the grooves 211. Plate springs 222, 223 are mounted to each side of standing breach 120 to engage and bias hand 209 against rear face 50 of cylinder 14. Plate spring 222, mounted on the right side of standing breach 120 when looking rearwardly, is mounted lower and in an overlapping relationship with plate spring 223, so that fingers 217, 218 are alternatively biased into the various grooves 211.

Figure 13:
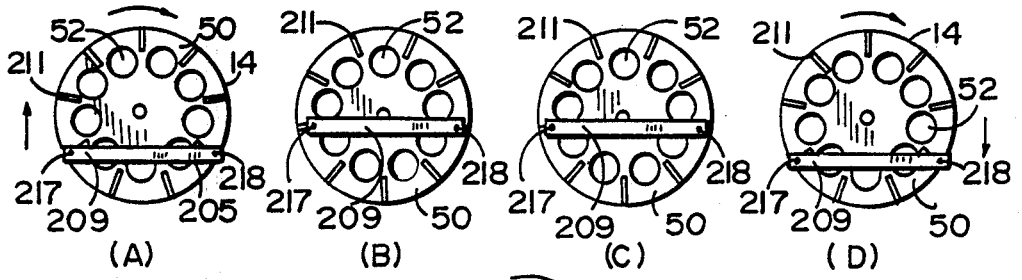
FIG. 13 (A)–(D) is a partially schematic rear view of the cylinder rotation.

For instance, as illustrated in FIGS. 13 (A)–(D), when revolver 10 is in its rest position (FIG. 13(A)), hand 209 is in its lowermost position. At this point, only plate spring 222 engages hand 209 and biases finger 217 toward cylinder 14 and in normal operation into an aligned left groove 211. (The darkened circle illustrates finger engagement with a groove 211). As hand 209 is moved upwardly, finger 217 rotates cylinder 14 in a clockwise direction (e.g. in a first twenty degrees as looking forwardly) to align one chamber 52 with barrel bore 25 (FIG. 13(B)). While hand 209 is moving upwardly, it will also engage plate spring 223, but hand 209 will not pivot about hand pin 220 because finger 218 rests against rear face 50 with no aligned groove 211 to receive it. Finger length are of such a dimension as to always maintain contact with rear face 50 of cylinder 14. Either right finger 217 is engaged in groove 211 while left finger 218 rests against rear face 50 of cylinder 14, or left finger 218 is engaged in groove 211 while right finger 217 rests against rear face 50 of cylinder 14. Plate springs 222 and 223 are less powerful than rebound spring 106, therefore cylinder 14 is forced rearward such that it bears against standing breach 120 with the abutment of nub 163. Plate springs 222 and 223 have the opportunity to operate on hand 209 only when both right and left grooves 211 are opposite the two fingers 217, 218, such as in FIGS. 13A and 13D (rest position) or FIGS. 13B and 13C (fire position). When hand 209 has reached its uppermost position (which is the firing position), plate spring 223 may be assured of moving finger 218 within the now-aligned right groove 211 (FIG. 13(C)). Then, when the hand 209 is moved downwardly once again, finger 218 continues the rotation of cylinder 14 (e.g. a second twenty degrees) in a clockwise direction to once again offset chambers 52 relative to barrel bore 25 (FIG. 13(D)).

Since hand 209 moves in a straight path and grooves 211 in arcuate paths, hand 209 will shift along the lengths of grooves 211 as it is reciprocated. This shifting action of fingers 217, 218 will function to clean dirt or debris from grooves 211. Grooves 211 are, of course, made with a sufficient radial length to facilitate the necessary freedom of movement of fingers 217, 218 received therein.

Cylinder retaining screw 135 operates to facilitate the alignment of finger 217 with on of the grooves 211 after revolver 10 has been tipped open along with also retaining cylinder 14 on barrel structure 12 (FIG. 7) as discussed above. This is accomplished by screw 135 being received within groove 211, which has been previously positioned thereby indexing mechanism 205, as barrel structure 12 is moved forwardly, to thereby inhibit rotation of cylinder 14. As seen in FIGS. 4, 13(A) and 13(D), one groove 211 will be aligned with screw 135 when revolver 10 is in its rest position, so that no additional action is required of the user when revolver 10 is to be tipped open. Note, however, that the user may rotate cylinder 14, when revolver 10 is opened, by manually biasing cylinder 14 against rebound spring 106 so that screw 135 is released from groove 211. Upon closing revolver 10, any misalignment of finger 217 with groove 211 that may result due to this action, will not disrupt the firing operation. If revolver 10 is closed with cylinder 14 in a non-aligned position, rear face 50 will engage both fingers 217, 218 thereby preventing cylinder 14 from slightly reaching standing breach 120 and resting there with nub 163. Rebound spring 106 overpowers both plate springs 222 and 223 and causes both fingers 217 and 218 to contact and support face 50 of cylinder 14. As indexing mechanism 205 moves hand 209 upwardly during a firing cycle, one of the fingers 217, 218 will eventually be received within the nearest available groove 211. After receipt therein, cylinder 14 will move slightly rearward under the influence of rebound spring 106 onto its final resting place against standing breach 120 with the contact of nub 163 thereagainst, and will either rotate clockwise (if finger 217 is received within groove 211) or counterclockwise (if finger 218 is received within groove 211). In either case, a chamber 52 would be moved into preliminary alignment with barrel bore 25 when hand 209 reaches its uppermost position (FIGS. 13(B) and (C)).

The rearward camming of the barrel structure 12 to form the leak resistant gas seal with cylinder 14, the rotation of cylinder 14 by index mechanism 205, and the firing of revolver 10 are all performed in a single operation of the user pulling trigger 186. A pair of control plates 255, mounted within frame 16, is responsible for coordinating these operations to be performed during firing.

More specifically, lock assembly 225 is mounted about three pivot axes 227, 228, 229 (FIG. 3) which are in a fixed relationship relative to frame 16. The first pivot axis 227 is defined by the pair of trigger pins 189, and as discussed above, pivotally mount trigger 186 to frame 16. Trigger 186 also includes a rearwardly extending platform 231 (FIG. 14) having a pair of spaced apart ears 233 extending therebeyond. Each ear 233 includes an upper engaging surface 236 which cooperates with a lever 237 (FIGS. 4–6). Lever 237 is pivotally mounted to frame 16 by lever pin 239 which defines he second fixed pivot axis 228 (FIG. 3). Trigger 186, then, acts to swing lever 237 in a pivoting motion about lever pin 239.

Lever 237 is of a substantially U-shaped configuration and is provided with a pair of parallel upwardly extending flanges 241 provided with holes 243 for receiving lever pin 239 therethrough, a pair of upwardly extending dog legs 245, and a downwardly extending channel portion 247 having an end bight 249 at its downwardmost point. Distal ends 251 of dog legs 245 are oriented to overlie and engage ears 233 of trigger 186. Hence, as trigger 186 is pulled rearwardly, or counterclockwise, by the user, ears 233 are swung upwardly and thereby drive dog legs 245 and hence, lever 237 about lever pin 239 in a clockwise direction as shown in FIGS. 4–6.

Extending from each side of lever 237, below dog legs 245, is a pin 253. Pin 253 is matingly received through opening 257 and is thereby adapted to movably couple a pair of control plates 255 to lever 237. Control plates 255 ar shaped identically and are preferably composed of a pair of thin planar plate members. Positioned upwardly from opening 257 is a bent slot 259 provided with a first track 261 and a second track 262 positioned at a lesser angle than first track 261, and a straight slot 264 which is positioned above and is of substantially the same inclination as second track 262.

Bent slot 259 is adapted to receive therethrough hammer pin 266 which is fixedly mounted to frame 16 and thereby defines the third fixed pivot axis 229 (FIG. 3). Hammer pin 266 additionally pivotally mounts hammer 268 to frame 16. Straight slot 264 is adapted to receive therethrough a stub pin 270 which is fixedly attached intermediately along indexing arm 272. Indexing arm 272 is directly connected to hand 209 at its forward portion by hand pin 220. Hence, the previously described reciprocal movements for hand 209 are facilitated by the actuation of indexing arm 272.

Indexing arm 272 further includes at its forwardmost portion a clevis structure 274 which is adapted to receive therein hand 209. Passing vertically through legs 275 of clevis structure 274 is hand pin 220 to pivotally mount hand 209 to indexing arm 272. At the rearwardmost position of indexing arm 272, is provided a bore 279 through which is received lever pin 239. Pin 239, then, functions to pivotally attach indexing arm 272 to frame 16. Also positioned medially along indexing arm 272 is an arcuate cut-out portion 281 which is adapted to receive and accommodate hammer pin 266 therethrough at the indexing arm's 272 lowermost position (which is the rest position). Lastly, indexing arm 272 is bifurcated at its central portion to define a cavity 283 therein, which is adapted to receive therethrough various other parts of lock assembly 225, as will be discussed in more detail below.

The functioning of the indexing operation is performed by the user pulling trigger 186 rearwardly or counterclockwise so that ears 233 engage distal ends 251 and thereby pivot lever 237 about lever pin 239 in a clockwise direction (FIGS. 5 and 6). As lever 237 is pivoted about lever pin 239, control plates 255 are moved upwardly such that first track 261 is driven along hammer pin 266. Since first track 261 is a steeper inclination than straight slot 264, stub pin 270 along with indexing arm 272 is driven upwardly with control plates 255. First track 261 embraces hammer pin 266 through this first fifty percent of trigger movement in its firing stroke, and hence, corresponds to the time in which cylinder 14 is rotated the first twenty degrees. During the second fifty percent of trigger movement, hammer pin 266 is embraced within second track 262. Second track 262 is at the same inclination as straight slot 264, and stub pin 270 slides in straight slot 264 in the same manner as hammer pin 266 is passed through second track 262. Therefore indexing arm 272 undergoes no further rotational motion through the second half of the trigger stroke.

As discussed previously, left finger 217 is received within one left groove 211 as indexing arm 272 is raised to its maximum position (FIGS. 13(A)–(B)). At this point, plate spring 223 takes over and hand 209 is pivoted about hand pin 220 so that finger 218 is now received within one right groove 211 (FIGS. 13(B)–(C)). In this position, as indexing arm 272 is lowered during the last fifty percent of the trigger rest stroke, right finger 218 further rotates cylinder 14 to once again offset chambers 52 with barrel bore 25 and firing pin 207 (FIGS. 13(C)–(D)). The lowering of indexing arm 272 is facilitated in the direct opposite manner as was discussed for the raising of arm 272; that is, that as hammer pin 266 is passed through first track 261 of bent slot 259 indexing arm 272 is brought down to its lowermost position (which is its rest position).

The firing action is also accomplished through a rearward pulling of trigger 186 and an interaction of lock assembly 225, that is known as "double action cocking". The double action firing method employs platform 231 of trigger 186. Engaging platform 231 is a double action sear 289. Double action sear 289 is pivotally mounted to a medial portion of hammer 268 through the use of sear pin 291, and is received for movement through cavity 283 of indexing arm 272.

More specifically, double action sear 289 is provided with a driving face 293 which abuts a flat abutting wall 295 of hammer 268 in order to pivotally move hammer 268 about hammer pin 266 in a clockwise direction (FIGS. 4–6). Note further, that located beneath driving face 293 is provided a bore 297 which receives therein a spring 299, which is typically of the coil spring variety. Coil spring 299 biases double action sear 289 about sear pin 291 so that driving face 293 normally engages abutting wall 295. The importance of this construction will become evident in the below discussion concerning the release of trigger 186 after firing.

Figure 8:
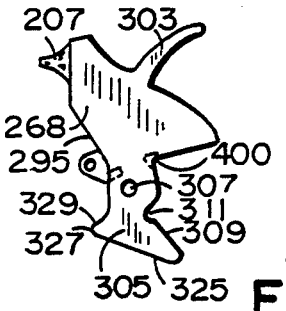
FIG. 8 is a left side elevational view of a hammer of the present invention.
Figure 9:
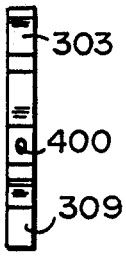
FIG. 9 is a rear view of the hammer.

Hammer 268 (FIGS. 8 and 14) is provided with a conventional firing pin 207 and finger cocking arm 303 on its upper portion. Its lower portion is constructed as a downwardly extending leg 305 received through cavity 283. Leg 305 is provided with a bore 307 through which is received hammer pin 266 to pivotally mount hammer 268 to frame 16. Positioned downwardly therefrom, along rearward edge 309 is provided an arcuate recess located at the inner vertex 400 in FIGS. 8, 9 and 14.

Main spring rod 287 is received through cavity 283 and extends downwardly through channel portion 247 of lever 237. Bight 249 is provided with a bore 313 through which is received the distal end of main spring rod 287. Main spring rod 287 is further provided with a fixed abutment 315 near upper end 317. Received between abutment 315 and bight 249 is pre-loaded main spring 285 in compression. Main spring 285 is preferably in the form of a coil spring and provides the force necessary to restore trigger 186 to its rest position and to cause hammer 268 to deliver ignition blows to cartridges in chambers 52.

As hammer 268 is pivoted clockwise through the force of double action sear 289, main spring rod 287 is rotated and forced downwardly through its abutment with inner vertex 400. As main spring rod 287 is forced downwardly, abutment 315 presses on main spring 285 to thereby compress it to store potential energy for future action. Additionally, trigger 186 is rotating counterclockwise and forcing distal ends 251 of lever 237 up causing lever 237 to rotate clockwise about lever pin 239 (FIGS. 4–6). This rotation causes bight 249 at the lowest end of lever 237 to also rotate about lever pin 239 and further compress main spring 285 (FIG. 6). Although main spring 285 is originally pre-loaded in compression in its assembled rest condition, this additional compression by abutment 315 of main spring rod 287 and bight 249 at opposite ends of main spring stores additional energy required to operate hammer 268 during firing and to restore trigger 186 to a rest position after firing. As can be seen in FIG. 6, main spring 285 is compressed to its maximum state immediately before firing, and supplies the driving force for moving the firing pin 207 against the cartridge in chamber 52 for firing. This firing is accomplished by completing the firing stroke of trigger 186 so that double action sear 289 comes off of platform 231 and falls into gap 319 which is defined between ears 233. At this point, release of double acting sear 289 from trigger 186, enables main spring 285 to expand and drive firing pin 207 into the awaiting cartridge in chamber 52.

After firing, trigger 186 is released and allowed to move forward to its rest position. As it so moves, the rearward edge 321 of platform 231 engages frontal wall 323 of double action sear 289. Coil spring 299 which normally biases double action sear 289 into engagement with abutting wall 295 for driving the hammer backwardly, is compressed in order to permit trigger 186 to continue its clockwise movement toward its rest position.

Hammer 268 is further provided with a groove 327 along is forward edge 325. Groove 327 enables hammer 268 to be cocked before actuation of trigger 186. In this operation, known as "single action cocking", the user engages finger cocking arm 303 and pulls hammer 268 rearwardly (that is, in a clockwise direction as seen in FIGS. 4–6). As hammer 268 pivots about hammer pin 266, knee 329 provided on a lower portion thereof, engages rearward edge 321 of platform 231 and drives trigger 186 counterclockwise about trigger pins 189. This trigger motion is the same motion given to it as when the user pulls directly upon finger receiving lip 191 as in "double action cocking". Hence, the indexing mechanism functions in exactly the same manner as if trigger 186 had been pulled directly. At the very end of the pivoting action for hammer 268 (that is, when cocking arm 303 is pulled back against frame 16) rearward edge 321 is received within groove 327 to so cock lock assembly 225 in a position immediately ready to fire. In this position, double action sear 289 does not function. The final firing action takes place when the user pulls trigger 186 rearwardly or counterclockwise, rearward edge 321 is dislodged from groove 327 thereby permitting main spring 285 to force main spring rod 287 upwardly and rotate hammer 286 in a counterclockwise fashion so that firing pin 30 strikes the cartridge contained within chamber 52.

After firing has taken place and trigger 186 is about to be released by the user to complete its forward (clockwise) motion to the rest position, firing pin 207 on hammer 268 must be retracted slightly from the primer of the cartridge just fired. This slight retraction is necessary to allow cylinder 14 uninhibited rotation by hand 209. Such hammer motion is known as "hammer rebound" and is accomplished by pin 253 on lever 237 sliding out of recess 311 and along rearward edge 309 of hammer 268 causing hammer 268 to rotate slightly clockwise as lever 237 rotates counterclockwise during the relaxing stroke of the trigger 186. As can be seen in FIG. 6, lever 237 is in its uppermost position (i.e. trigger at 99% stroke) and will remain in this position during the hammer fall firing the cartridge as trigger 186 is pulled slightly. As hammer 268 falls on the Cartridge primer, recess 311 rotates counterclockwise and embraces, but does not touch, pin 253 on lever 237. Then, during the relaxing stroke of trigger 186, lever 237 draws pin 253 along an arch centered at pin 239, out of recess 311 and along rearward edge 309 also arc-shaped and concentric with pin 239, to thereby cause hammer 268 to rebound slightly clockwise so that firing pin 207 is lifted from the primer in the just-fired cartridge. This hammer rebound is designed to take place simultaneously with barrel rebound (i.e during the first fifty percent of relaxing stroke of trigger 186) and prior to final rotation of cylinder 14 by hand 209 during the last fifty percent of relaxing stroke of trigger 186.

Lock assembly 225 is preferably mounted within a casing 331 (FIG. 3). Casing 331 is fixedly mounted to frame 16 and is provided with three holes 333, 334, 335 which receive therethrough trigger pins 189, lever pin 239, and hammer pin 266, respectively. Although, if desired, casing 331 could be completely eliminated because it is simply used to facilitate easy assembly and disassembly.

Of course, it is understood that the above descriptions are those of preferred embodiments of the invention. Various other embodiments, as well as many changes and alterations, may be made without departing from the spirit and broader aspects of the invention as defined in the claims.

The embodiments of the invention in which an exclusive property or privilege is claimed are defined as follows.

1. A gas seal revolver comprising:

a frame;

a barrel having a longitudinal bore extending therethrough with forward and rearward ends, and a first seal element extending about a marginal portion of said rearward end of said bore;

means for mounting said barrel on said frame to permit longitudinal motion therebetween;

a cylinder positioned adjacent and operably supported on said barrel, said cylinder having a plurality of parallel chambers, adapted to receive cartridges therein, with ends which open toward said barrel and a second seal element extending about a marginal portion of each said chamber end and shaped to engage said first seal element and therewith form a leak-resistant gas seal; and means for shifting said barrel between a firing position wherein said first and second seal elements are engaged to seal said barrel bore and said cylinder chamber for increased projectile speed, and a rest position wherein said first and second seal elements are disengaged to permit said cylinder and said barrel to move with respect to one another;

said barrel further being pivotally mounted on said frame to permit said barrel and said cylinder to tip open on said frame to facilitate reloading and cleaning of said revolver.

2. The gas seal revolver of claim 1 in which said barrel is provided with a first holding means and said frame is provided with a second holding means which engages with said first holding means to thereby prevent said barrel and said cylinder from pivoting to tip open on said frame; and a biasing means for biasing said first holding means into engagement with said second holding means, whereby said first and second holding means are disengaged to permit pivoting of said barrel and cylinder to open on said frame solely by shifting said barrel longitudinally against said biasing means.

3. The gas seal revolver of claim 1 in which said frame is provided with an opening;

said barrel is provided with a first extension which is movably received into and out of said opening, whereby said barrel and cylinder are prevented from pivoting to tip open on said frame when said extension is received within said opening; and a biasing means for biasing said barrel into said opening, wherein said barrel is released from said frame for said pivoting solely by moving said barrel out of said recess against said biasing means.

4. The gas seal revolver of claim 3 in which said biasing means is also operatively associated with both said barrel and said cylinder such that said biasing means biases said barrel and said cylinder apart so as to disengage said first and second seal elements.

5. The gas seal revolver of claim 3 in which said barrel is provided with a second extension having a notch therein; and a trigger mechanism being pivotally mounted to said frame for reciprocal movement through a predetermined stroke and having a pin which cooperates with said notch, whereby said pin engages said notch for a portion of said stroke and thereby prevents said first barrel extension from moving out of said opening so that said barrel and cylinder may not be pivoted to said tipped open position during said portion of said trigger stroke.

6. The gas seal revolver of claim 5 which further includes a firing pin, and in which said cylinder is rotatably mounted to said barrel, and in which said trigger mechanism is operatively coupled to said cylinder such that said cylinder is moved in predetermined increments as said trigger mechanism is moved wherein said cylinder is rotatably positioned between a rest position wherein said barrel bore, said chambers and said firing pin are not aligned and a firing position wherein one of said chambers is in alignment with said barrel bore and said firing pin, whereby said revolver may not be accidentally or inadvertently fired when said cylinder is in its rest position, and wherein said first seal element extends from said barrel bore whereby said first seal element abuts said cylinder and prevents movement of said barrel into a sealing condition with said cylinder.

7. The gas seal revolver of claim 1 further including a trigger mechanism movably mounted on said frame and operatively coupled to said barrel for shifting said barrel relative to said frame.

8. The gas seal revolver of claim 1 further including a biasing means operatively associated with said barrel and said cylinder for biasing said barrel and said cylinder apart to disengage said first and second seal elements.

9. The gas seal revolver of claim 1 in which said first seal element includes an annular ridge provided about said rearward end of said bore and said second seal element includes a countersink about said chamber end, whereby said leak resistant gas seal is formed by said ridge being received within said countersink.

10. A gas seal revolver comprising:

a frame;

a barrel having a longitudinal bore extending therethrough with forward and rearward ends, and a first seal element extending about a marginal portion of said rearward end of said bore;

means for mounting said barrel on said frame to permit longitudinal motion therebetween;

a cylinder positioned adjacent said barrel and having a plurality of parallel chambers, adapted to receive cartridges therein, with ends which open toward said barrel and a second seal element extending about a marginal portion of each said chamber end and shaped to engage said first seal element and therewith form a leak-resistant gas seal;

a trigger mechanism movably mounted on said frame and operatively coupled to said barrel for shifting said barrel relative to said frame between a firing position wherein said first and second seal elements are engaged to seal said barrel bore and said cylinder chamber for increased projectile speed and a rest position wherein said first and second seal elements are disengaged to permit said cylinder and said barrel to move with respect to one another; and an indexing mechanism which cooperates with said trigger mechanism and said cylinder, such that said indexing mechanism rotates said cylinder a predetermined distance to align said chamber with said barrel bore as said trigger mechanism is pulled in a normal firing motion, and further rotates said cylinder so as to move said chamber out of alignment with said barrel bore as said trigger is returned to its rest position.

11. The gas seal revolver of claim 10 in which said indexing mechanism functions to preliminarily align said barrel bore and said chamber and wherein said engagement of said first and second seal elements effects a final alignment between said barrel bore and said chambers.

12. A gas seal revolver comprising:

a frame;

a firing pin mounted on said frame;

a barrel having a longitudinal bore extending therethrough with forward and rearward ends, and a first seal element extending about a marginal portion of said rearward end of said bore;

means for mounting said barrel on said frame to permit longitudinal motion therebetween;

a cylinder positioned adjacent said barrel and rotatably mounted to said barrel said cylinder having a plurality of chambers, adapted to receive cartridges therein, with ends which open toward said barrel and a second seal element extending about a marginal portion of each said chamber end and shaped to engage said first seal element and therewith form a leak-resistant gas seal; and a trigger mechanism for shifting said barrel between a firing position wherein said first and second seal elements are engaged to seal said barrel bore and said cylinder chamber for increased projectile speed, and a rest position wherein said first and second seal elements are disengaged to permit said cylinder and said barrel to move with respect to one another, said trigger mechanism further being operatively coupled to said cylinder such that said cylinder is moved in predetermined increments as said trigger mechanism is moved, wherein said cylinder is rotatably moved between a rest position wherein said chambers and said firing pin are not aligned, and a firing position wherein one of said chambers is in alignment with said firing pin, whereby said revolver may not be accidentally or inadvertently fired when said cylinder is in its rest position.

13. The gas seal revolver of claim 12 in which said trigger mechanism is movable through a reciprocal firing and rest stroke and is operatively coupled to said cylinder through an indexing mechanism which rotates said cylinder from said rest position to said firing position through a first half of said firing stroke, and which rotates said cylinder from its firing position to its rest position through a second half of said rest stroke.

14. The gas seal revolver of claim 13 in which said trigger mechanism:

(a) cooperates with said indexing mechanism to rotate said cylinder to its firing position during the first half of said trigger firing stroke;

(b) cooperates with said barrel to shift said barrel against said cylinder to form said leak resistant gas seal during said second half of said trigger firing stroke;

(c) cooperates with said barrel to shift said barrel away from said cylinder to disengage said first and second seal elements during said first half of said trigger rest stroke; and (d) cooperates with said indexing mechanism to rotate said cylinder to its rest position during the second half of said trigger rest stroke.

15. A gas seal revolver comprising:

a frame;

a barrel having a longitudinal bore extending therethrough with forward and rearward ends, and a first seal element extending about a marginal portion of said rearward end of said bore;

means for mounting said barrel on said frame to permit longitudinal motion therebetween;

a cylinder positioned adjacent said barrel and having a plurality of parallel chambers, adapted to receive cartridges therein, with ends which open toward said barrel and a second seal element extending about a marginal portion of each said chamber end and shaped to engage said first seal element and therewith form a leak-resistant gas seal, said cylinder further including an outer peripheral surface, opposite side surfaces and a plurality of radially extending grooves provided in one of said side surfaces in spaced apart intervals along said outer peripheral surface;

a trigger mechanism for shifting said barrel between a firing position wherein said first and second seal elements are engaged to seal said barrel bore and said cylinder chamber for increased projectile speed, and a rest position wherein said first and second seal elements are disengaged to permit said cylinder to move with respect to said barrel; and an indexing mechanism, wherein said indexing mechanism cooperates with said trigger mechanism and said grooves in said cylinder to rotate said cylinder with respect to said barrel bore for advancing the next cartridge.

16. A gas seal revolver comprising:

a frame;

a barrel having a longitudinal bore extending therethrough with forward and rearward ends, and a first seal element extending about a marginal portion of said rearward end of said bore;

means for mounting said barrel on said frame to permit longitudinal motion therebetween;

a cylinder positioned adjacent said barrel and having a plurality of parallel chambers, adapted to receive cartridges therein, with ends which open toward said barrel and a second seal element extending about a marginal portion of each said chamber end and shaped to engage said first seal element and therewith form a leak-resistant gas seal, said cylinder further including an outer peripheral surface, opposite side surfaces and a plurality of radially extending grooves provided in one of said side surfaces in spaced apart intervals along said outer peripheral surface;

a trigger mechanism for shifting said barrel between a firing position wherein said first and second seal elements are engaged to seal said barrel bore and said cylinder chamber for increased projectile speed, and a rest position wherein said first and second seal elements are disengaged to permit said cylinder to move with respect to said barrel; and an indexing mechanism, wherein said indexing mechanism cooperates with said trigger mechanism and said grooves in said cylinder to rotate said cylinder with respect to said barrel bore for advancing the next cartridge, said indexing mechanism further including a pivotally mounted member with two ends wherein each end is provided with means for engaging said grooves, means for reciprocally moving said member in a path along said one side surface with said grooves and means for biasing said two engaging means alternatively into said grooves, whereby said cylinder is rotated when one of said engaging means engages one of said grooves and said moving means moves said member in said path.

17. The gas seal revolver of claim 16 in which said grooves are provided with an open outer end, and said engaging means moves in a path that is different than the rotation of said cylinder such that said engaging means is shifted along the length of said groove as said moving means moves said member in said path, whereby said grooves are cleaned by the operation of said indexing mechanism.

18. A gas seal revolver comprising:

a frame including a first holding structure;

a barrel having a longitudinal bore extending therethrough with forward and rearward ends, a first seal element extending about a marginal portion of said rearward end of said bore, and a second holding structure;

a cylinder operably supported on said barrel and having at least one chamber, adapted to receive a cartridge therein, with an end which opens toward said barrel and a second seal element extending about a marginal portion of said chamber end and shaped to engage said first seal element and form therewith a leak-resistant gas seal;

means for shifting one of said barrel and said cylinder between a firing position wherein said first and second seal elements are engaged to seal said barrel bore and said cylinder chamber for increased projectile speed, and a rest position wherein said first and second seal elements are disengaged to permit said cylinder to move with respect to said barrel bore;

means for pivotally mounting said barrel to said frame to permit said barrel and said cylinder to tip open on said frame to facilitate reloading and cleaning of said revolver and for mounting said barrel on said frame to permit longitudinal motion therebetween, wherein said first holding structure engages said second holding structure to thereby prevent said barrel and said cylinder from pivoting to said tipped open position; and a biasing means for biasing said second holding structure into engagement with said first holding structure, whereby said first and second holding structures are disengaged to permit pivoting of said barrel and cylinder into said tipped open position solely by shifting said barrel longitudinally against said biasing means.

19. A gas seal revolver comprising:

a frame including an opening;

a barrel having a longitudinal bore extending therethrough with forward and rearward ends, a first seal element extending about a marginal portion of said rearward end of said bore, and a first extension movably received into and out of said opening;

a cylinder operably supported on said barrel and having at least one chamber, adapted to receive a cartridge therein, with an end which opens toward said barrel and a second seal element extending about a marginal portion of said chamber end and shaped to engage said first seal element and form therewith a leak-resistant gas seal;

means for shifting one of said barrel and said cylinder between a firing position wherein said first and second seal elements are engaged to seal said barrel bore and said cylinder chamber for increased projectile speed and a rest position wherein said first and second seal elements are disengaged to permit said cylinder to move with respect to said barrel bore;

means for pivotally mounting said barrel to said frame to permit said barrel and said cylinder to tip open on said frame to facilitate reloading and cleaning of said revolver, said barrel and cylinder being prevented from pivoting to said tipped open position when said extension is received within said opening; and a biasing means for biasing said barrel into said opening, whereby said barrel is released from said frame for pivoting solely by moving said barrel out of said opening against said biasing means.

20. The gas seal revolver of claim 19 in which said biasing means is also operatively associated with both said barrel and said cylinder such that said biasing means biases said barrel and said cylinder apart so as to disengage said first and second seal elements.

21. The gas seal revolver of claim 19 in which said barrel is provided with a second extension having a notch therein;

a trigger mechanism being pivotally mounted to said frame for reciprocal movement through a predetermined stroke and having a pin which cooperates with said notch, whereby said pin engages said notch for a portion of said stroke and thereby prevents said first barrel extension from moving out of said recess for pivoting said barrel and cylinder to said tipped open position.

22. A gas seal revolver, comprising:

a frame;

a firing mechanism mounted on said frame;

a barrel including a longitudinal bore extending therethrough with a rearward end having a first seal element extending about a marginal portion thereof;

means for mounting said barrel on said revolver in a manner which permits longitudinal motion between said barrel and said frame;

a cylinder positioned for rotation adjacent said barrel, and including a plurality of chambers shaped to receive cartridges therein; said cylinder chambers including exterior ends, and interior ends which open toward said barrel with a second seal element extending about a marginal portion of each of the interior chamber ends shaped to selectively engage said first seal element and therewith form a leak-resistant gas seal;

means for shifting said barrel between a firing position wherein said first and second seal elements are engaged to seal said barrel bore and a selected one of said cylinder chambers for increased projectile speed, and a rest position wherein said first and second seal elements are disengaged to permit said cylinder to rotate with respect to said barrel;

means for mounting said cylinder on said revolver in a manner which permits said cylinder to be selectively shifted between a closed operational position wherein the exterior ends of said chambers are disposed generally adjacent to said firing mechanism for revolver operation, and an open non-operational position wherein the exterior ends of said chambers are spaced apart from said firing mechanism and are exposed to facilitate reloading and cleaning said revolver.

23. A gas seal revolver as set forth in claim 22, including:

a releasable cylinder lock shiftable between a locked position wherein said cylinder is positively retained in said closed operational position, and an unlocked position wherein said cylinder is free to move to the open non-operational position.

24. A gas seal revolver as set forth in claim 23, including:

means for automatically shifting said cylinder lock into the locked position as said barrel is shifted into the fire position.

25. A gas seal revolver as set forth in claim 24, including:

means for automatically shifting said cylinder lock into the unlocked position as said barrel is shifted into the rest position.

26. A gas seal revolver as set forth in claim 25, wherein:

said barrel shifting means defines said cylinder lock shifting means, whereby the motion of said barrel converging with said cylinder automatically and positively retains said cylinder in the closed operational position.

* * * * *